United States Patent [19]

Maros

[11] Patent Number: 4,536,053

[45] Date of Patent: Aug. 20, 1985

[54] CONNECTOR ASSEMBLY HAVING GROUNDING STRAP

[75] Inventor: Ronald R. Maros, Itasca, Ill.

[73] Assignee: Cooper Industries, Inc., Houston, Tex.

[21] Appl. No.: 525,636

[22] Filed: Aug. 23, 1983

[51] Int. Cl.[3] ..... H01R 13/648

[52] U.S. Cl. ..... 339/143 R; 339/14 R; 339/17 F

[58] Field of Search ..... 339/14 R, 143 R, 136 R, 339/136 M, 97 R, 97 P, 17 F, 176 MF; 179/117 F, 78

[56] References Cited

U.S. PATENT DOCUMENTS 3,999,830 12/1976 Herrmann et al. ..... 339/136 M 4,416,501 11/1983 Fusselman et al. ..... 339/97 R

*Primary Examiner*—Eugene F. Desmond

*Attorney, Agent, or Firm*—Fitch, Even, Tabin & Flannery

[57] ABSTRACT

A connector assembly for terminating a shielded flat cable of the type comprising an array of generally parallel, regularly spaced coplanar conductors embedded in an insulative layer with a metallic shield surrounding the conductors. The connector assembly includes a pair of metallic components adapted for assembly to form a housing. The assembly further includes a one-piece metallic grounding strap having a first leg, a second leg and a spring arm extending therebetween the legs and together with the legs defining a channel for receiving the cable. The housing formed by the metallic components defines a void for receiving the strap. The strap has a height greater than the corresponding dimension of the void so that by placing the cable in the channel and in one of the housing components, bending of the shield back over the spring arm and assembling the housing, the spring arm holds the shield in the firm contact with the housing.

4 Claims, 6 Drawing Figures

CONNECTOR ASSEMBLY HAVING GROUNDING STRAP

BACKGROUND OF THE INVENTION

The present invention relates to a connector for terminating conductors and, more particularly, to a connector assembly for terminating a shielded, jacketed flat cable.

The use of flat cables for interconnecting components of electrical and electronic equipment has been rapidly increasing. Flat cable allows high density wiring, offers a neat appearance, and is conducive to use with labor saving mass termination insulation displacement connectors. It is sometimes necessary to shield the signal conductors in the flat cable from stray voltages or current induced by electrical fields by surrounding the conductors with a metal foil or braid connected to ground.

Typically, the shield is grounded by stripping away an end portion of the outer jacket of the cable, folding the exposed portion of the shield back over the jacket and bolting together a pair of metallic blocks with the exposed shield positioned therebetween. It will be appreciated that this grounding method is time consuming and operator judgment is required regarding the degree of tightening of the blocks. Inadequate tightening results in poor electrical contact between the blocks and the shield while excessive tightening of the blocks beyond the elastic limits of the jacket material and other insulation could result in short circuiting of the conductors. Additionally, this grounding method relies on the resiliency of the jacket and insulation to maintain firm contact between the blocks and shield. With age, the plastic material between the blocks loses its resiliency and takes a permanent set thereby degrading the contact between the foil and blocks.

One proposed connector assembly for terminating a shielded flat cable includes a pair of grounding straps for holding the cable shield therebetween. Each strap has ends terminating in eyelets for receiving a screw for holding the straps together by attaching them to a connector housing component, and one strap is bowed and the other is flat. For further information regarding the structure and operation of such connector assembly, reference may be made to U.S. Pat. No. 3,337,834.

SUMMARY OF THE INVENTION

Among the several objects of the present invention may be noted the provision of an improved connector assembly for terminating a shielded flat cable; the provision of such connector assembly which uses only a single strap not connected to any other component of the assembly; the provision of such connector apparatus which avoids reliance on the resiliency of insulation of the flat cable to maintain firm contact of the connector with the shield; the provision of such connector assembly which is fast and reliable in use, has long service life, and is easy and economical to manufacture. Other objects and features of the present invention will be in part apparent and in part pointed out hereinafter in the specification and attendant claims.

The connector assembly of the present invention comprises a pair of metallic components adapted for assembly to form a housing, and a one-piece metallic grounding strap. The strap includes a first leg, a second leg, and a spring arm extending therebetween and together with the legs defining a channel for receiving the strap. The housing defines a void for receiving the strap and the strap has a height greater than the corresponding dimension of the void. Upon placing the cable in the channel and in one of the housing components, bending of the cable shield back over the spring arm and assembling the housing results in the spring arm holding the shield in firm contact with one of the housing components.

BRIEF DESCRIPTION OF THE DRAWINGS

Corresponding reference characters indicate corresponding parts throughout the several views of the drawings.

DESCRIPTION OF THE PREFERRED EMBODIMENT

Figure 4:
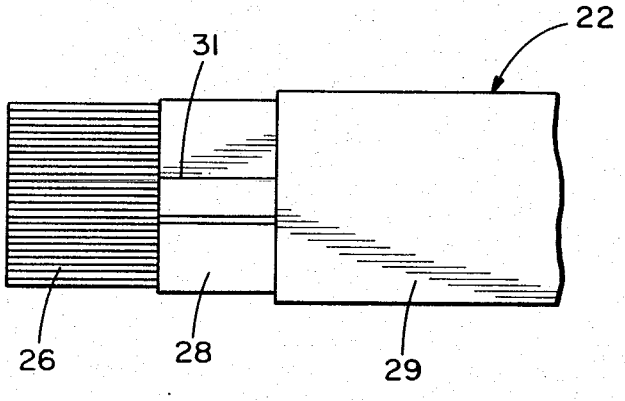
FIG. 4 is a plan of a shielded flat cable for use with the connector assembly, with certain components removed to expose other components.

Referring now to the drawings, a connector assembly for terminating a shielded, jacketed flat cable 22 is generally indicated by reference character 20. Flat cable 22, best shown in FIG. 4, includes an array of generally parallel, regularly spaced conductors 24 extending intermediate the sides of the cable and embedded in a layer of insulation 26. A metallic shield 28, formed of foil or a braid, surrounds conductors 24, and the cable further comprises an outer sheath 29 of flexible, insulative material and one or more wires 31 disposed in contact with the shield. Typically, both layer 26 and sheath 30 are made of a tough plastic such as polyvinyl chloride.

Figure 2:
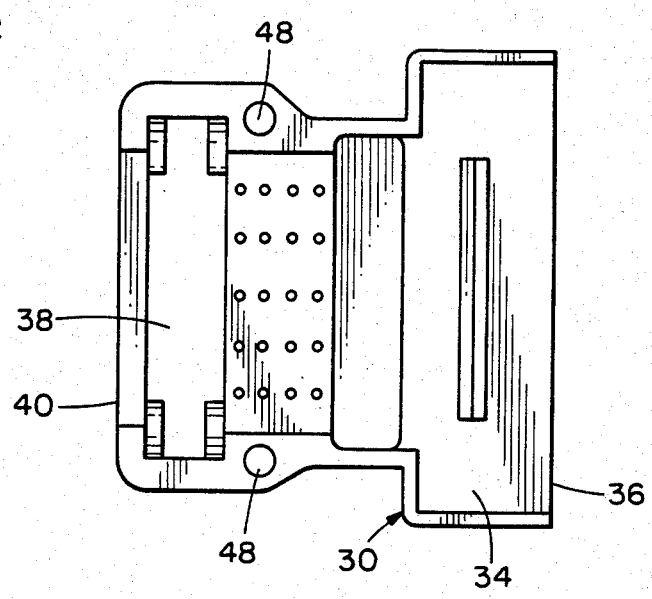
FIG. 2 is a plan of one of a pair of housing halves of the connector assembly.
Figure 3:
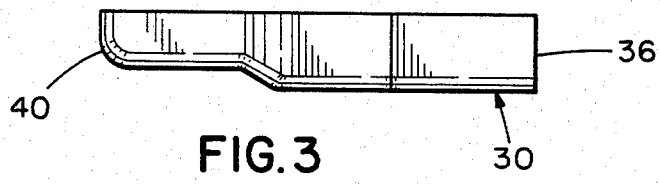
FIG. 3 is a side elevational view of the housing half of FIG. 2.
Figure 5:
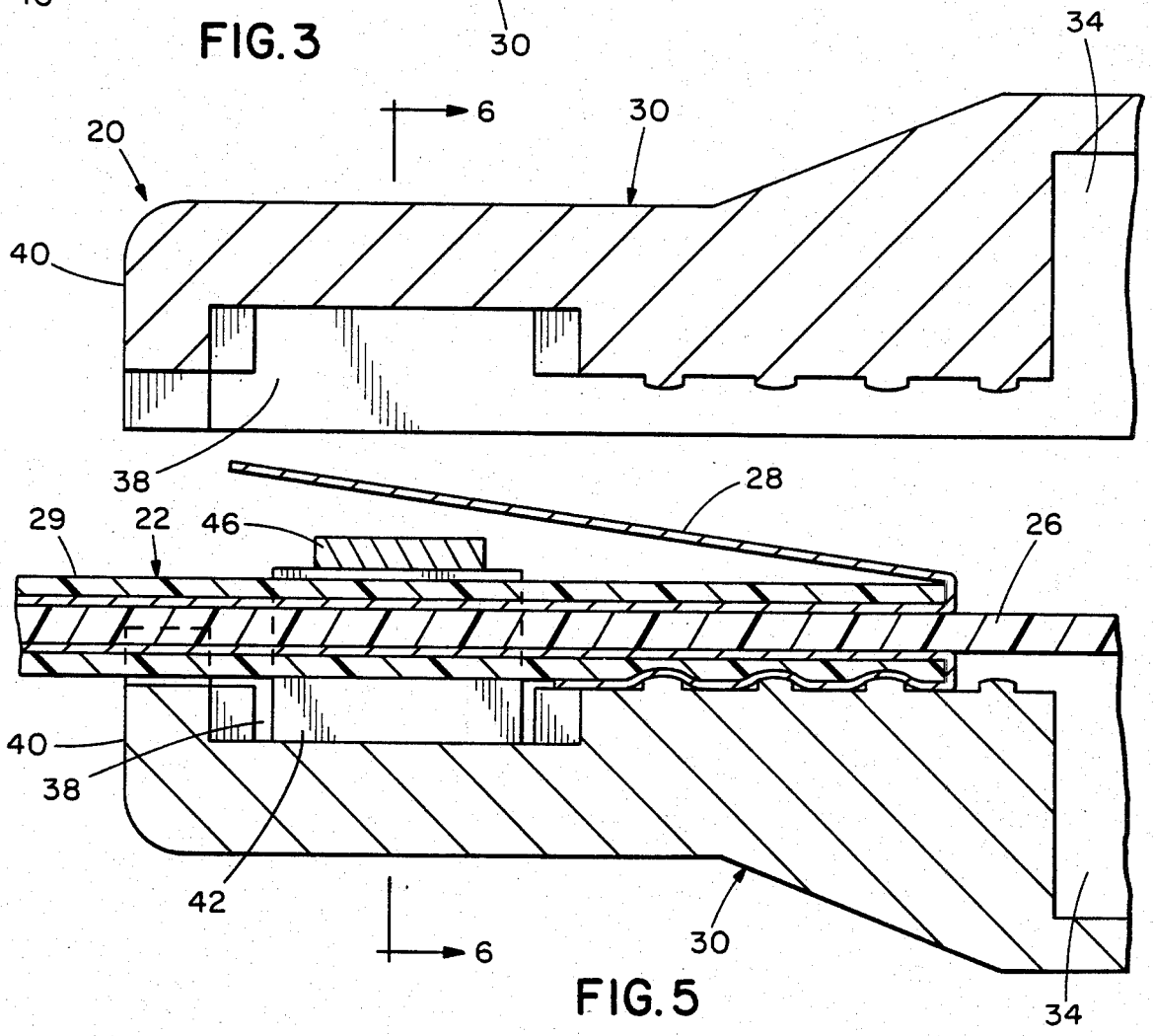
FIG. 5 is a side view of the partially assembled housing with the shield being folded back on itself over the strap.
Figure 6:
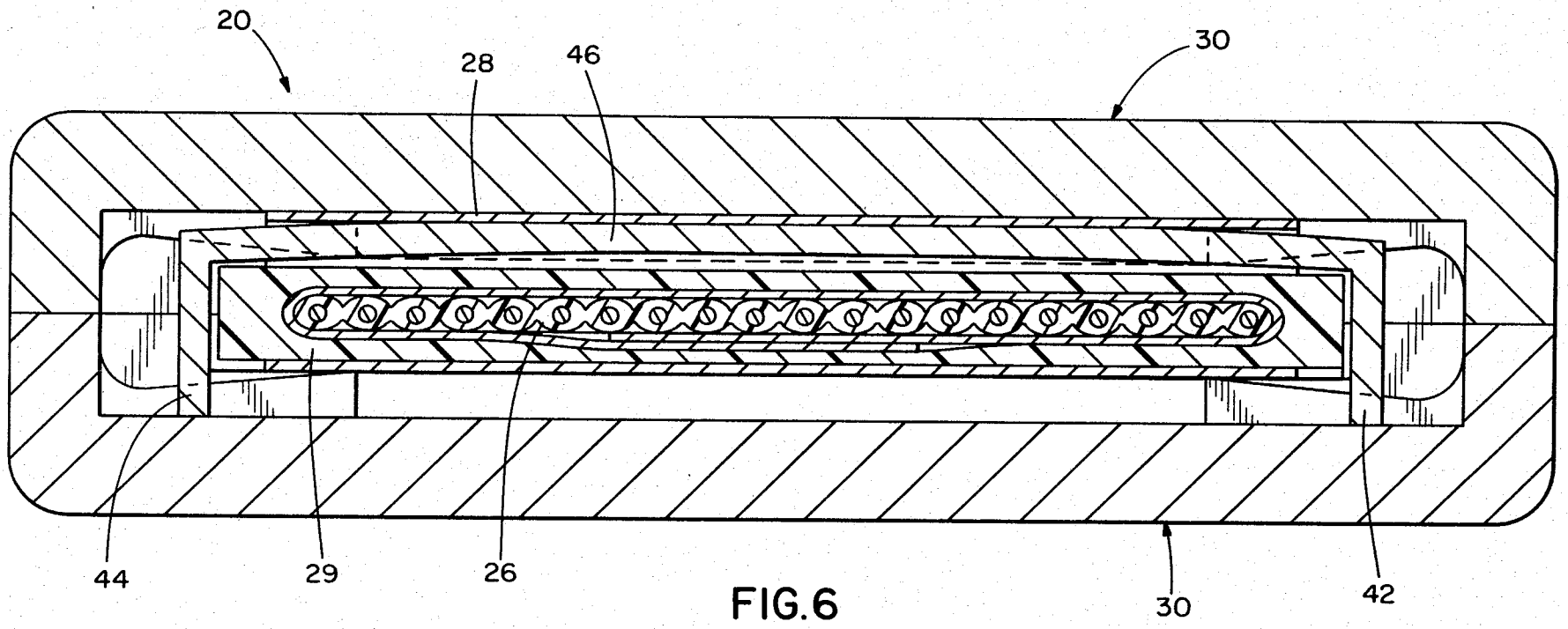
FIG. 6 is a sectional view of the connector assembly.

Connector assembly 20 includes a pair of metallic components such as housing halves 30, best shown in FIGS. 2 and 3, for assembly together to form a housing. When assembled, the housing defines a cavity for receiving an end portion of cable 22, a U-shaped grounding strap 32 for pushing shield 28 into firm contact with the housing and a connector for terminating the various conductors in the flat cable. The connector may be of the type having an insulative housing for holding an array of metallic terminal elements each having an insulation displacement portion for terminating one of the flat cable conductors, and a connection portion (such as a pin) for making contact with another electrical component. Such connectors are well known to those of skill in the art and need not be discussed further.

The housing cavity extends the length of the housing and, besides including the pass path of the cable, includes voids for receiving the connector and the strap 32. Each housing half 30 includes a deep recess 34 at its forward end 36 for seating the connector, a shallow recess 38 adjacent its rearward end 40 for receiving strap 32, and an intermediate section disposed between the recesses and having an array of raised stipples extending into the pass path for the cable to indent sheath 30 to hold the cable from movement in the assembled housing.

Grounding strap 32 is of one-piece metallic construction and comprises a first leg 42, a second leg 44 and a spring arm 46 extending therebetween and together with the legs defining a channel for receiving cable 22. The spring arm 46 is bowed outwardly and the strap has a greater height than the housing void for receiving the strap so that assembly of the halves 30, by joining them using threaded fasteners extending through eyelets 48 adjacent the margins of the halves, results in straightening of the arcuate spring arm. Alternatively, spring arm 46 could be flat and the facing surface of the housing half could be outwardly bowed to achieve the desideratum of deforming the spring arm upon assembly of the halves 30 so that a portion of shield 28 disposed between one of the halves and the spring arm is held in firm mechanical contact with the housing.

Figure 1:
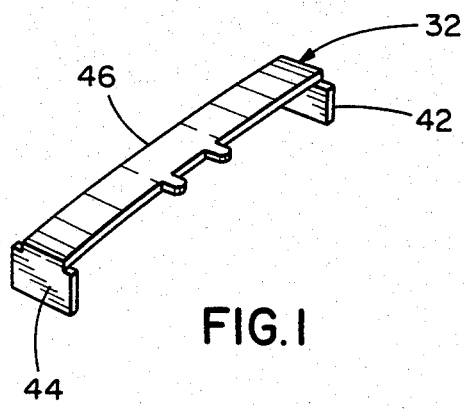
FIG. 1 is a perspective view of a grounding strap used in the connector assembly of the present invention.

As shown in FIG. 1, the ends of legs 42, 44 remote from spring arm 46 are not connected. The legs extend generally normally from the spring arm, and their distal ends engage the housing half 30 not contacted by the shield. If it is desired to have the shield contact both housing halves, a four sided strap could be used; that is a second spring arm would join the ends of the legs remote from arm 46. Besides any additional difficulty in formation, such enclosed strap would have the shortcoming that it could be applied only from an end of the cable.

Operation of the connector assembly of the present invention is as follows: After stripping sheath 29 from the end portion of cable 22 and trimming shield 28 so that there is a sufficient length to fold back over spring arm 46, the cable end is terminated in the connector. The connector is placed in the deep recess 34 of one of the housing halves 30. Strap 32 is installed in the shallow recess 38 with legs 42, 44 flanking the cable and spring arm 46 overlaying sheath 29. The length of shield 28 is then folded back over spring arm 46 and the remaining housing half 30 positioned so that the housing can be assembled. It will be appreciated that the grounding path of the shield includes the metallic housing and the conductive component of a piece of electrical equipment to which the housing is attached.

As a method of grounding the shield of a shielded flat cable using a connector assembly, the present invention includes the following steps:

(a) One end of the cable is placed in one of the housing halves.

(b) The strap is positioned over the cable end with the legs of the strap flanking the cable and engaging one housing half.

(c) The shield of the cable is bent back over the spring arm.

(d) The remaining housing half is positioned and the housing assembled.

(e) The housing is connected to ground.

In view of the above, it will be seen that the several objects of the present invention are achieved and other advantageous results attained.

As various changes could be made in the above constructions without departing from the scope of the present invention, it is intended that all matter contained in the above description shall be interpreted as illustrative and not in a limiting sense.

What is claimed is:

1. A connector assembly for terminating a shielded flat cable of the type comprising an array of generally parallel, regularly spaced coplanar conductors embedded in an insulative layer with a metallic shield surrounding said conductors; said connector assembly comprising:

a pair of metallic components adapted for assembly to form a housing; and a one-piece metallic grounding strap comprising a first leg, a second leg and a spring arm extending therebetween and together with said legs defining a channel for receiving said cable, said housing defining a void for receiving said strap and said strap having a height greater than the corresponding dimension of said void whereby placing said cable in said channel and in one of the housing components, bending said shield back over said spring arm and assembling said housing results in said spring arm holding said shield in firm contact with said one of the housing components.

2. A connector assembly as set forth in claim 1 wherein at least one of (1) said spring arm and (2) the facing surface of the housing component engaging said shield, is outwardly bowed with respect to the other.

3. A connector assembly as set forth in claim 1 wherein the ends of said legs remote from said spring arm are not connected and said legs extend generally normally from said spring arm, the remote ends of said legs engaging the other housing component.

4. A method of grounding the shield of a shielded flat cable using a connector assembly having a metallic housing having two housing halves and having a U-shaped grounding strap comprising first and second legs with a spring arm extending therebetween, the ends of said legs remote from said spring arm not being connected; said method comprising the following steps:

(a) placing the end of said cable in one of the housing halves;

(b) placing said strap with the spring arm over the cable with the legs engaging said one housing half after the completion of step (a);

(c) bending the shield over said spring arm;

(d) assembling said housing, and (e) connecting said housing to ground.

* * * * *